US010966531B2

(12) United States Patent
France

(10) Patent No.: US 10,966,531 B2
(45) Date of Patent: Apr. 6, 2021

(54) ERGONOMIC CHAIR

(71) Applicant: David James France, Macau (CN)

(72) Inventor: David James France, Macau (CN)

( * ) Notice: Subject to any disclaimer, the term of this patent is extended or adjusted under 35 U.S.C. 154(b) by 150 days.

(21) Appl. No.: 16/243,097

(22) Filed: Jan. 9, 2019

(65) Prior Publication Data

US 2019/0223603 A1 Jul. 25, 2019

(30) Foreign Application Priority Data

Jan. 25, 2018 (HK) ..... 18101217.5

(51) Int. Cl.

| | |
|---|---|
| ***A47C 7/48*** | (2006.01) |
| ***A47C 3/30*** | (2006.01) |
| ***A47C 7/00*** | (2006.01) |
| ***A47C 7/54*** | (2006.01) |
| ***A47C 7/18*** | (2006.01) |
| ***A47C 7/02*** | (2006.01) |

(52) U.S. Cl.

CPC ..... *A47C 7/48* (2013.01); *A47C 3/30* (2013.01); *A47C 7/004* (2013.01); *A47C 7/006* (2013.01); *A47C 7/029* (2018.08); *A47C 7/18* (2013.01); *A47C 7/54* (2013.01)

(58) Field of Classification Search

CPC .. A47C 7/48; A47C 7/029; A47C 3/30; A47C 7/004; A47C 7/006; A47C 7/18; A47C 7/54

USPC ..... 297/344.19, 344.26

See application file for complete search history.

(56) References Cited

U.S. PATENT DOCUMENTS

| | | | | |
|---|---|---|---|---|
| 3,905,642 A * | 9/1975 | Simjian | ..... | A47C 7/62 297/344.26 |
| 4,709,963 A | 12/1987 | Uecker et al. | | |
| 5,203,853 A | 4/1993 | Caruso | | |
| 9,010,867 B2 * | 4/2015 | Martin | ..... | A47C 3/029 297/344.19 X |

FOREIGN PATENT DOCUMENTS

| | | | | |
|---|---|---|---|---|
| CN | 1242178 A | 1/2000 | | |
| CN | 106942930 A | 7/2017 | | |
| DE | 9303222 U1 * | 5/1993 | ..... | A47C 7/48 |
| JP | 10215978 A * | 8/1998 | ..... | A47C 7/48 |
| JP | 2002262953 A | 9/2002 | | |

* cited by examiner

*Primary Examiner* — Anthony D Barfield

(57) ABSTRACT

An ergonomic chair, includes: a support structure, a seat assembly, and a backrest. The seat assembly includes a seat and a seat mount arranged on the support structure. The backrest is rotatably connected to the support structure through a backrest support, and the backrest is configured to be rotatable and fixed relative to the seat assembly.

15 Claims, 9 Drawing Sheets

ERGONOMIC CHAIR

CROSS REFERENCE TO RELATED APPLICATIONS

This application is based upon and claims priority to Hong Kong's Patent Application No. 18101217.5, filed on Jan. 25, 2018 the entire contents of which are incorporated herein by reference.

TECHNICAL FIELD

This invention relates to chairs, and more particularly to an ergonomic chair.

BACKGROUND

Many people suffer back and/or neck pain at some point during their lives. Poor posture and its contribution to spine related ailments is both well documented and well understood.

A person suffering back pain is highly motivated to gain a permanent solution. Correlation between postural factors and back pain are well documented and well understood by sufferers.

The problem with conventional chairs is they hold our body in an unnatural position that puts strain on the back. Over time this causes many back related problems including, back ache, head ache, pain referral and poor posture.

Research is also showing it has significant other less obvious effects such as increased incidence in bowel cancer and other organic issues due to prolonged compression of abdominal contents while seated.

Though back pain represents the biggest cause of absenteeism from work, seating posture in the work place has been poorly addressed. Ergonomic chairs currently occupy a very small portion of the work seat market. There are different options available but together they are still relatively uncommon particularly out in the workplace. Several "Saddle Chairs" are on the market, but they all significantly lack features in terms of comfort, function and aesthetics.

The most aesthetically pleasing chair that allows the pelvis to tilt and elevated with respect to the knees is the HAG Capisco chair, as shown in FIG. 1, but this significantly loses in the function stakes as an ergonomic chair. The classic "ergonomic" office chairs, as shown in FIG. 2, of which there are thousands, achieve very little unless the person's knees are below the hips and pelvis is tilted forward. The Balans chair with fixed knee bar, as shown in FIG. 3, puts undue pressure on the knees is very restricting and potentially dangerous on lower discs. It's also unappealing. The large ball is cumbersome and unappealing.

SUMMARY

Disclosed herein is an ergonomic chair, comprising: a support structure, a seat assembly comprising a seat and a seat mount arranged on the support structure, and a backrest rotatably connected to the support structure through a backrest support, wherein the backrest is configured to be rotatable and fixed relative to the seat assembly.

In some embodiments, the ergonomic chair further comprising:

a rotating mechanism comprising:

a rotating sleeve connected to the backrest support, and a bearing module arranged within the rotating sleeve, and a lock mechanism comprising:

a lock handle, a lock lever with one end pivotally connected to the seat mount and the other end connected to the lock handle, an elastic component connected between the lock lever and the seat mount, a lock member extending towards the rotating sleeve from the lock lever, at least one cutout arranged along the perimeter of the rotating sleeve, each cutout being sized to receive the lock member, and a slot hole opened into the seat mount through which the lock member is movable to shift between a locking state in which the lock member is forced by the elastic component to move into the at least one cutout and a unlocking state in which the lock member is forced by a user against the elastic component to move out of the at least one cutout, thereby the backrest is rotatable and fixed relative to the seat assembly.

In some embodiments, the lock mechanism comprises two cutouts diametrically opposite to each other such that the backrest is rotatable to either a backward position where the backrest is located behind the user or a forward position where the backrest is located in front of the user.

In some embodiments, the elastic component is a spring.

In some embodiments, the rotating sleeve and the backrest support form a unitary body.

In some embodiments, the rotating sleeve is removably connected to the backrest.

In some embodiments, the support structure further comprises a height adjusting mechanism comprising:

a pneumatic rod passing through a bottom opening opened at a depression formed within the seat mount, a height adjusting lever passing through side walls of the depression, a height adjusting handle connected to one end of the height adjusting lever, and an angle plate fixed onto a section of the height adjusting lever within the depression, wherein the angle plate is configured for pressing down a piston rod of the pneumatic rod when the height adjusting handle is lifted by a user.

In some embodiments, the support structure further comprises a plurality of legs each being mounted with a swivel caster.

In some embodiments, the seat mount is made of metal.

In some embodiments, wherein the backrest further comprises a main portion, a first armrest portion and a second armrest portion extending from the main portion laterally in opposite directions.

In some embodiments, the main portion further comprises a top section, a middle section and a bottom section, and the backrest further comprises a first arc-shaped section formed between the top section and the first armrest portion, a second arc-shaped section formed between the top section and the second armrest portion, a third arc-shaped section formed between the bottom section and the first armrest portion, and a fourth arc-shaped section formed between the bottom section and the second armrest portion.

In some embodiments, the top section and the bottom section both taper to the middle section by their width.

In some embodiments, the backrest further comprises a backrest frame and a backrest cover attached onto the backrest frame.

In some embodiments, the backrest is made of plastic.

In some embodiments, the backrest cover is made of foam and fabric.

In some embodiments, the backrest frame is hollow with a opening through which the backrest support is inserted into the hollow backrest frame for attachment thereto.

In some embodiments, the seat further comprises a seat base arranged on the seat mount, a seat frame attached onto the seat base, and a seat cushion attached onto the seat frame.

In some embodiments, the seat base and the seat frame are made of plastic.

In some embodiments, the seat cushion is made of foam and fabric.

In some embodiments, the seat comprises a rear portion which is shaped to accommodate a user's hip and a raised front portion.

Further disclosed herein is an ergonomic chair, comprising:

a support structure, a seat assembly comprising a seat, and a seat mount arranged on the support structure, and a backrest rotatably connected to the support structure through a backrest support, a rotating mechanism comprising:

a rotating sleeve connected to the backrest support, and a bearing module arranged within the rotating sleeve, and a lock mechanism comprising:

a lock handle, a lock lever with one end pivotally connected to the seat mount and the other end connected to the lock handle, an elastic component connected between the lock lever and the seat mount, a lock member extending towards the rotating sleeve from the lock lever, at least one cutout arranged along the perimeter of the rotating sleeve, each cutout being sized to receive the lock member, and a slot hole opened into the seat mount through which the lock member is movable to shift between a locking state in which the lock member is forced by the elastic component to move into the at least one cutout and a unlocking state in which the lock member is forced by a user against the elastic component to move out of the at least one cutout, thereby the backrest is rotatable and fixed relative to the seat assembly.

In some embodiments, the support structure further comprises a height adjusting mechanism comprising:

a pneumatic rod passing through a bottom opening opened at a depression formed within the seat mount, a height adjusting lever passing through side walls of the depression, a height adjusting handle connected to one end of the height adjusting lever, and an angle plate fixed onto a section of the height adjusting lever within the depression, wherein the angle plate is configured for pressing down a piston rod of the pneumatic rod when the height adjusting handle is lifted by a user.

In some embodiments, the support structure further comprises a plurality of legs each being mounted with a swivel caster.

In some embodiments, the seat mount is made of metal.

In some embodiments, the backrest further comprises a main portion, a first armrest portion and a second armrest portion extending from the main portion laterally in opposite directions.

In some embodiments, the main portion further comprises a top section, a middle section and a bottom section, and the backrest further comprises a first arc-shaped section formed between the top section and the first armrest portion, a second arc-shaped section formed between the top section and the second armrest portion, a third arc-shaped section formed between the bottom section and the first armrest portion, and a fourth arc-shaped section formed between the bottom section and the second armrest portion.

In some embodiments, the top section and the bottom section both taper to the middle section by their width.

In some embodiments, the backrest further comprises a backrest frame and a backrest cover attached onto the backrest frame.

In some embodiments, the backrest is made of plastic.

In some embodiments, the backrest cover is made of foam and fabric.

In some embodiments, the backrest frame is hollow with a opening through which the backrest support is inserted into the hollow backrest frame for attachment thereto.

In some embodiments, the seat further comprises a seat base arranged on the seat mount, a seat frame attached onto the seat base, and a seat cushion attached onto the seat frame.

In some embodiments, the seat base and the seat frame are made of plastic.

In some embodiments, the seat cushion is made of foam and fabric.

In some embodiments, the seat comprises a rear portion which is shaped to accommodate a user's hip and a raised front portion.

According to the present invention, the backrest can be interchanged from the backward and forward positions or removed altogether. With the backrest in the rotated position it is ideal to work off a laptop, tablet or smart phone. With a small amount of weight on the feet the chair is extremely mobile—ideal for the modern workplace. With the rotating backrest it is ideally suited to sitting at the desk in the office or home office.

BRIEF DESCRIPTION OF THE DRAWINGS

The novel features believed to be characteristic of the invention are set forth in the appended claims and claims yet to be filed. However, the invention itself, as well as a preferred mode of use and further objectives and advantages thereof, will best be understood by reference to the following detailed description when read in conjunction with the accompanying Figures wherein:

DETAILED DESCRIPTION OF THE EMBODIMENTS

Figure 1:
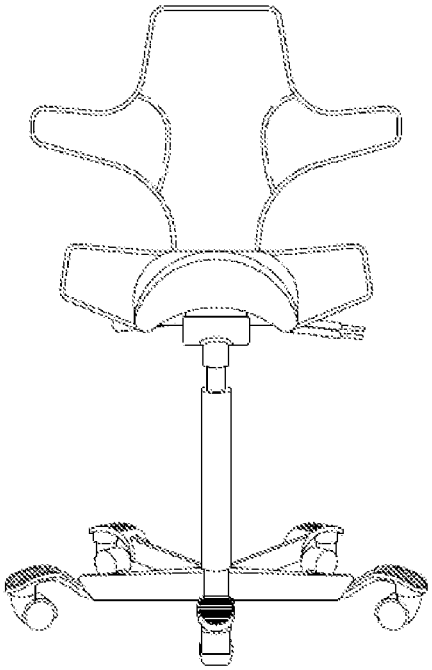
FIG. 1 is a perspective view of a prior art chair.
Figure 2:
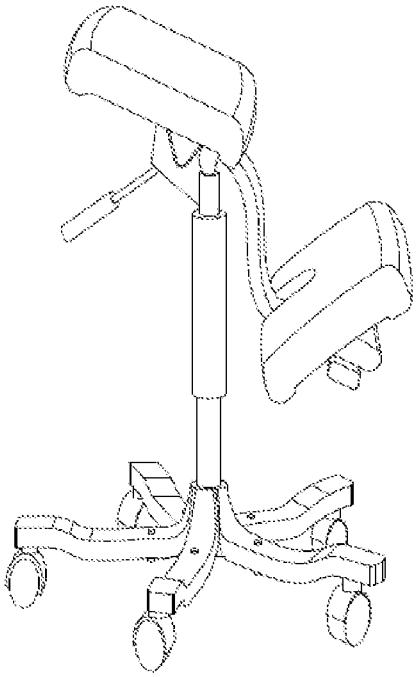
FIG. 2 is a perspective view of a prior art chair.
Figure 3:
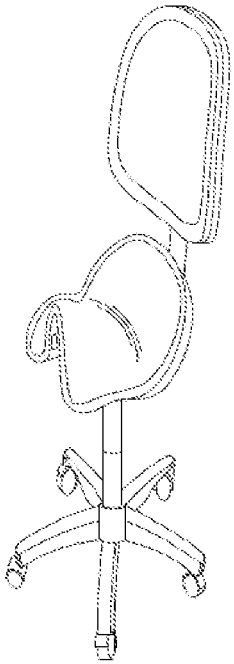
FIG. 3 is a perspective view of a prior art chair.

Detailed description of the preferred embodiment is provided herein. It is to be understood, however, that the present invention may be embodied in various forms. Various aspects of the invention may be inverted, or changed in reference to specific part shape and detail, part location, or part composition. Therefore, specific details disclosed herein are not to be interpreted as limiting, but rather as a basis for the claims and as a representative basis for teaching one skilled in the art to employ the present invention in virtually any appropriately detailed system, structure or manner.

Turning to the FIG. 4, FIG. 5, FIG. 6, and FIG. 7, which are perspective view of the ergonomic chair in accordance with the preferred, illustrated embodiment of the present invention from a variety of angles. The ergonomic chair comprises a support structure 100, a seat assembly 200 comprising a seat 210 and a seat mount 220 arranged on the support structure 100, and a backrest 300 rotatably connected to the support structure 100 through a backrest support 310.

Figure 6:
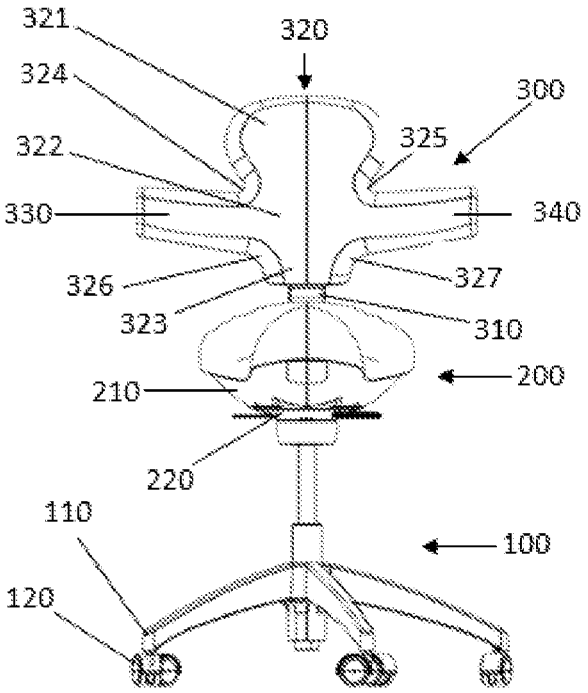
FIG. 6 is a perspective view of the ergonomic chair in accordance with an embodiment of the present invention.
Figure 7:
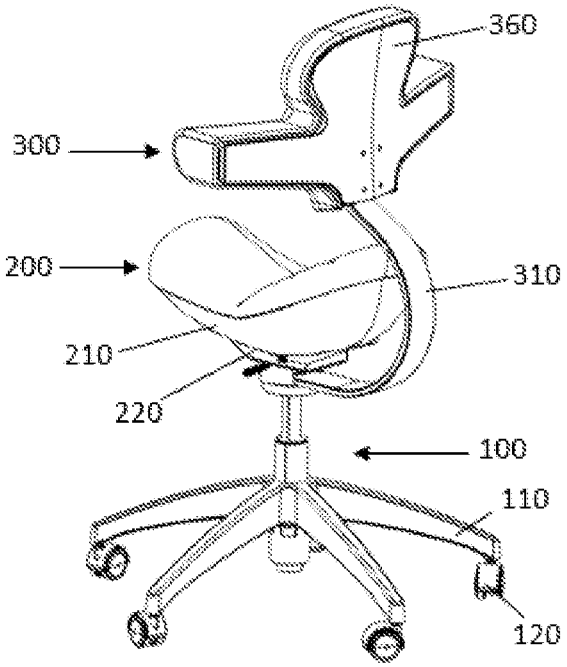
FIG. 7 is a perspective view of the ergonomic chair in accordance with an embodiment of the present invention.

In a preferred embodiment of the present invention, referring particularly to FIG. 6, the backrest 300 further comprises a main portion 320, a first armrest portion 330 and a second armrest portion 340 extending from the main portion 320 laterally in opposite directions. The first armrest portion 330 and the second armrest portion 340 on one hand are shaped to form cooperatively with the main portion 320 a backrest 300 for a user's back to rest thereon when the backrest 300 is in a backward position, and on the other hand to serve as an armrest for a user's arm to rest thereon when the backrest 300 is changed from the backward position to a forward position.

In a preferred embodiment of the present invention, referring again to FIG. 6, the main portion 320 further comprises a top section 321, a middle section 322 and a bottom section 323. In particularly, the first armrest portion 330 and the second armrest portion 340 extend from the middle section 322 laterally in opposite direction. The backrest 300 further comprises a first arc-shaped section 324 formed between the top section 321 and the first armrest portion 330, a second arc-shaped section 325 formed between the top section 321 and the second armrest portion 340, a third arc-shaped section 326 formed between the bottom section 323 and the first armrest portion 330, and a fourth arc-shaped section 327 formed between the bottom section 323 and the second armrest portion 340. The first arc-shaped section 324 and the second arc-shaped section 325 are shaped such that they can accommodate the user' arms comfortably. The top section 321 and the bottom section 322 both taper to the middle section 322 by their width.

Figure 4:
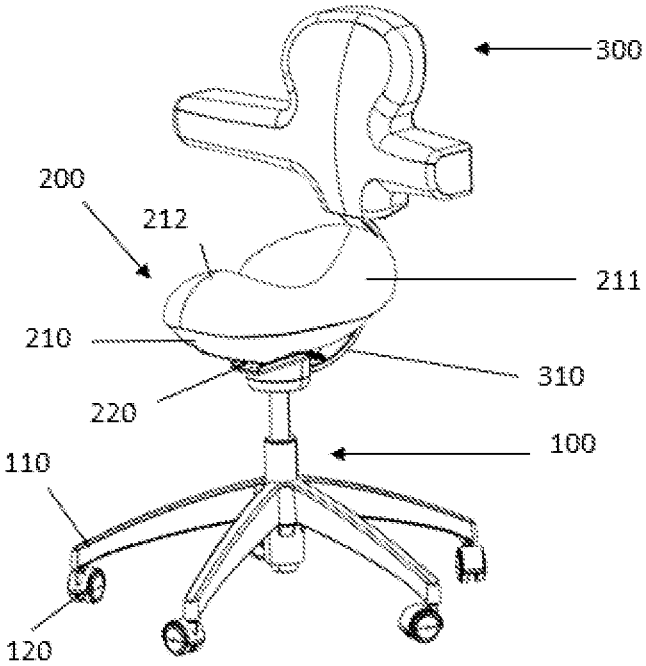
FIG. 4 is a perspective view of the ergonomic chair in accordance with an embodiment of the present invention.
Figure 5:
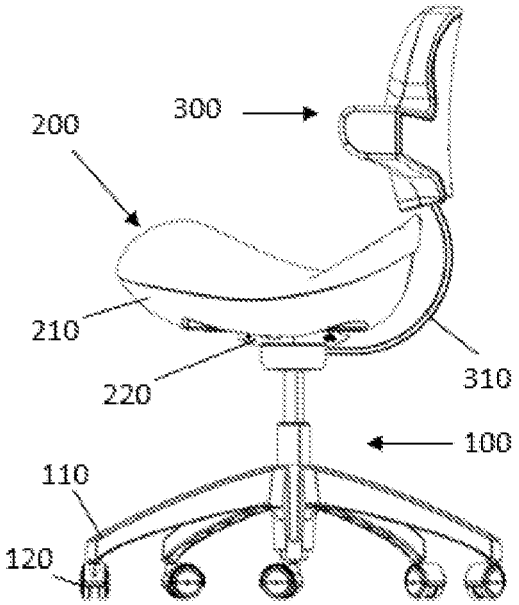
FIG. 5 is a perspective view of the ergonomic chair in accordance with an embodiment of the present invention.
Figure 8:
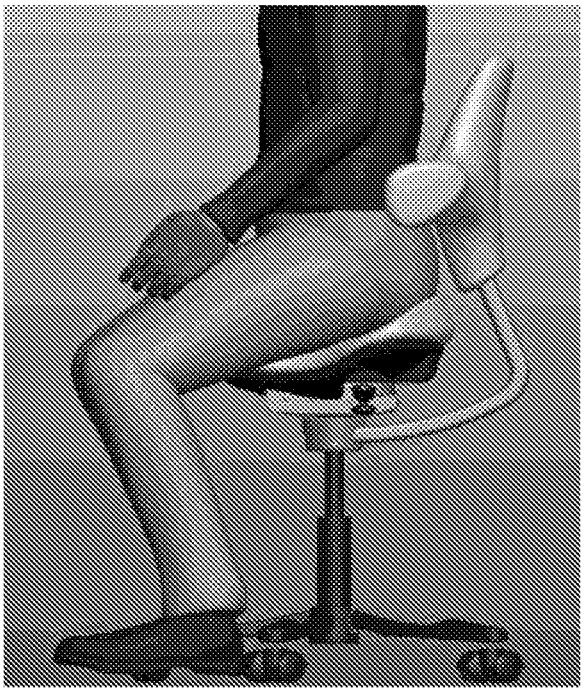
FIG. 8 is a perspective view of the ergonomic chair with a person sitting thereon in accordance with an embodiment of the present invention.

In a preferred embodiment of the present invention, referring particularly to FIG. 4, the seat 210 further comprises a rear portion 211 which is shaped to accommodate a user's hip and a raised front portion 212, see particularly FIG. 8 which is a perspective view of the ergonomic chair with a person sitting thereon in accordance with the present invention.

Figure 9:
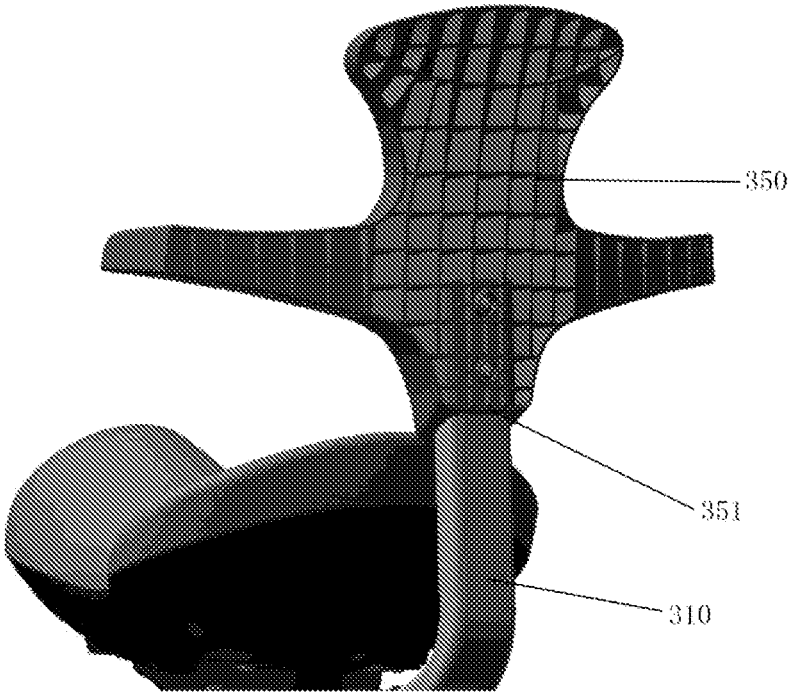
FIG. 9 is a close-up view of the backrest frame showing that the backrest frame attached to the backrest support in accordance with an embodiment of the present invention.

In a preferred embodiment of the present invention, the backrest 300 comprises a backrest frame 350 and a backrest cover 360 (see particularly FIG. 9) attached onto the backrest frame 350. The backrest frame 350 is preferably hollow with an opening 351 through which the backrest support 310 is inserted into the hollow backrest frame 350 for attachment thereto. Now referring to FIG. 9, which is a close-up view of the backrest frame 350 showing that the backrest frame 350 attached to the backrest support 310. In this embodiment, the backrest frame 350 is threaded to the backrest support 310. However, any know, appropriate connection for the backrest frame to the backrest support may be used without departing from the scope of the present invention.

In a preferred embodiment of the present invention, the backrest frame is made of plastic and the backrest cover is made of foam and fabric. However, any known, appropriate material may be used for the backrest frame and the backrest cover without departing from the scope of the present invention.

Figure 11:
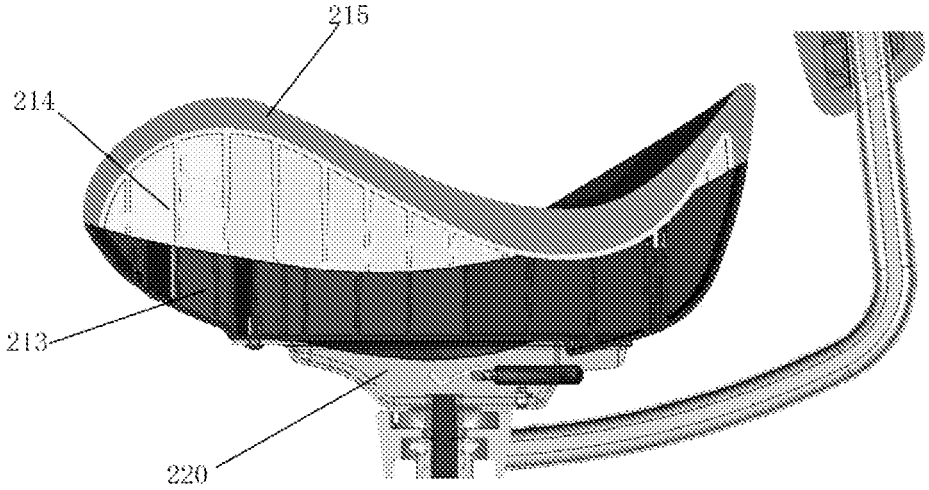
FIG. 11 shows the details of the seat assembly in accordance with an embodiment of the present invention.

Now referring to FIG. 11, which shows the details of the seat assembly 200 according to an embodiment of the present invention. In this embodiment, the seat 210 further comprises a seat base 213 arranged on the seat mount 220, a seat frame 214 attached onto the seat base 213, and a seat cushion 215 attached onto the seat frame 214. In a preferred embodiment of the present invention, the seat base 213 and the seat frame 214 are made of plastic, the seat cushion 215 is made of foam and fabric. The foam application process causes the foam to adhere to the top surface of the plastic. Preferably, the seat mount 220 is made of metal. However, any known, appropriate material may be used for the seat base, the seat frame, seat cushion and the seat mount without departing from the scope of the present invention.

Figure 10:
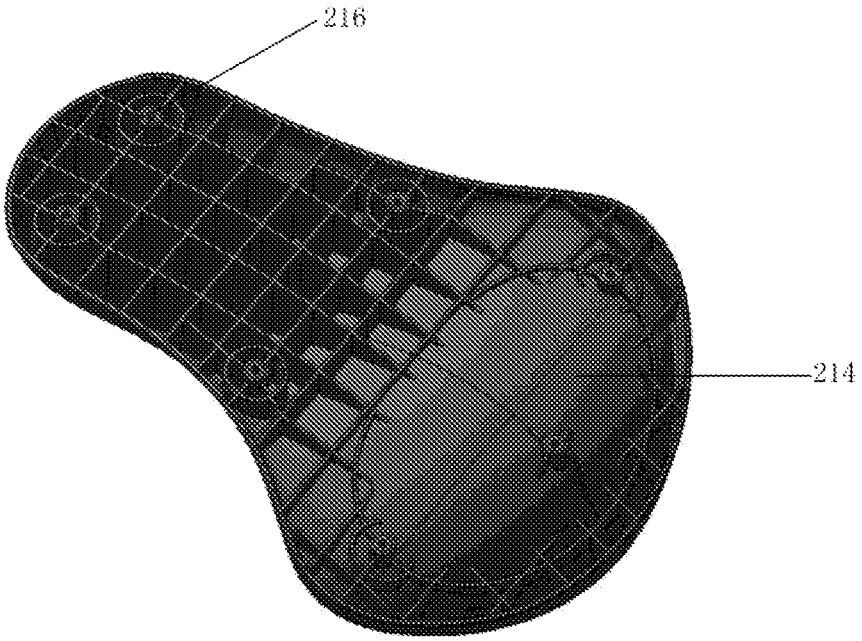
FIG. 10 shows nuts used to attach the seat frame and the seat base together in accordance with an embodiment of the present invention.
Figure 12:
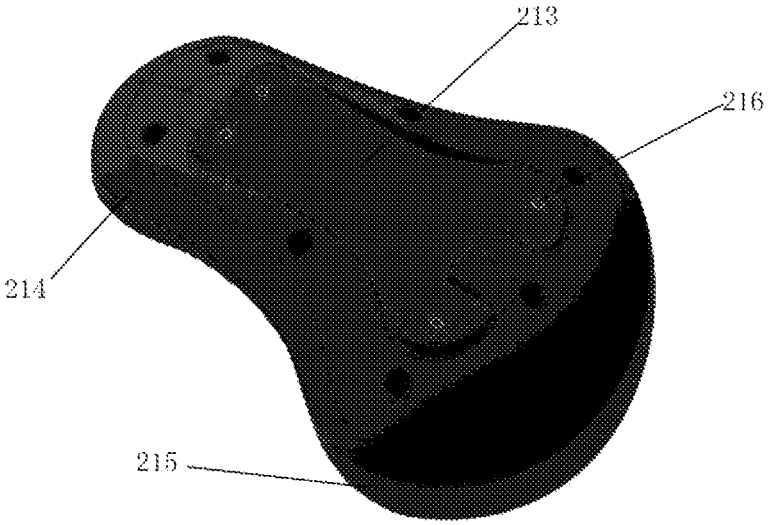
FIG. 12 shows copper nuts molded onto the seat base for fastening onto the seat mount in accordance with an embodiment of the present invention.

In a preferred embodiment of the present invention, copper nuts 216 may be permanently fastened to the plastic seat frame 214 using plastic injection insert-molding. The nuts 216 can be used to attach the seat frame 214 and the seat base 213 together, as shown in FIG. 10. In the illustrated embodiment, there are four copper nuts 216 molded onto the seat base 213 for fastening onto the seat mount 220, as shown in FIG. 12.

Figure 13:
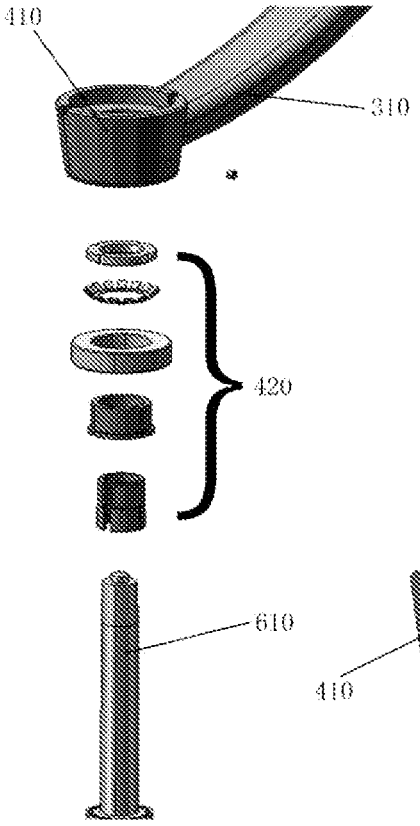
FIG. 13 shows the rotating mechanism in exploded form in accordance with an embodiment of the present invention.
Figure 14:
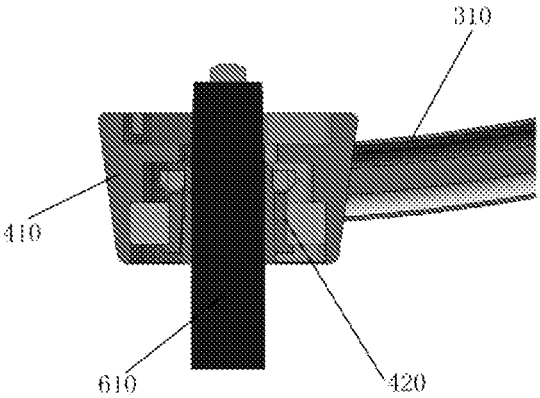
FIG. 14 shows the rotating mechanism in assembled form in accordance with an embodiment of the present invention.

In a preferred embodiment of the present invention, the backrest 300 is configured to be rotatable and fixed relative to the seat assembly 200. This is done by further comprising a rotating mechanism 400 and a lock mechanism 500. The rotating mechanism is illustrated in an exploded form in FIG. 13, and in assembled form in FIG. 14. In the illustrated embodiment, the rotating mechanism 400 may comprise a rotating sleeve 410 connected to the backrest support 310, and a bearing module 420 arranged within the rotating sleeve 410. The bearing module 420 is sleeved onto a pneumatic rod 610, which will be described below, so as to be capable of rotating together with the rotating sleeve 410 about the pneumatic rod 610, thereby achieving rotation of the backrest 300.

Figure 17:
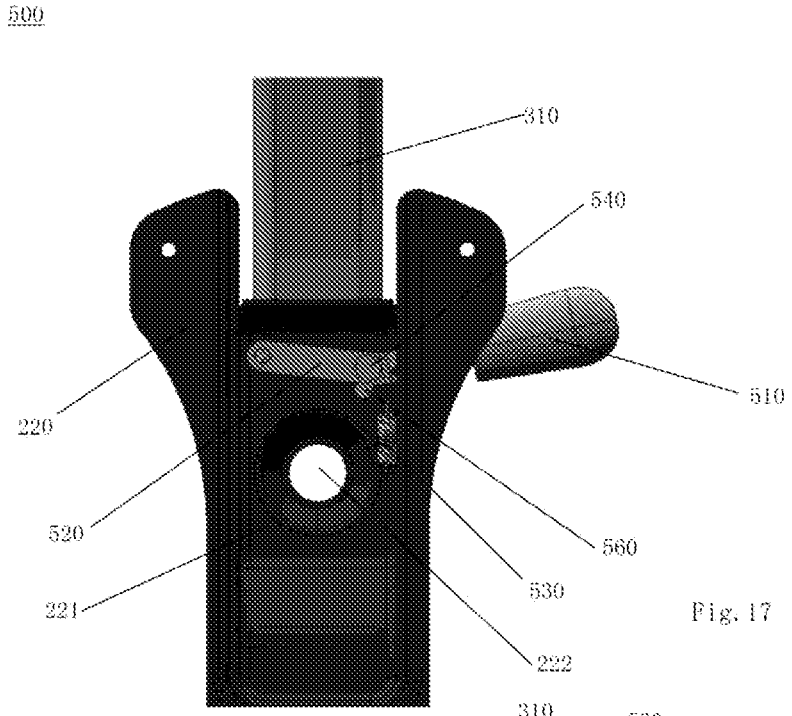
FIG. 17 shows the top view of the lock mechanism in an unlocking state in accordance with an embodiment of the present invention.
Figure 18:
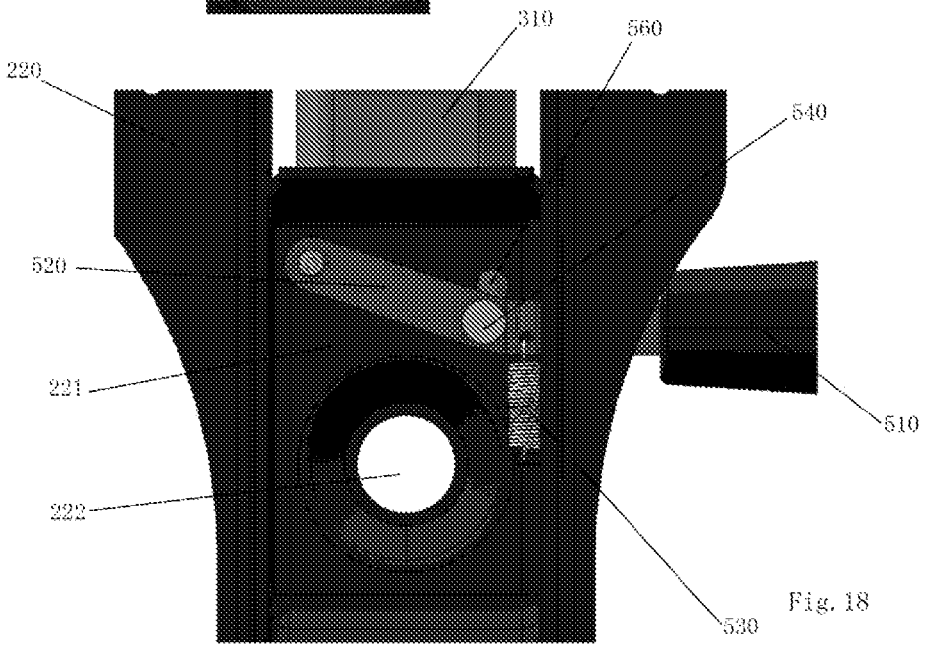
FIG. 18 shows the top view of the lock mechanism in a locking state in accordance with an embodiment of the present invention.

Turning next to FIG. 17 and FIG. 18, the lock mechanism is illustrated in a top view. In the illustrated embodiment, the lock mechanism 500 may comprise a lock handle 510, a lock lever 520 with one end pivotally connected to the seat mount 220 and the other end connected to the lock handle 510, an spring 530 connected between the lock lever 520 and the seat mount 220, a lock member 540 extending towards the rotating sleeve 410 from the lock lever 520, at least one cutout 550 arranged along the perimeter of the rotating sleeve 410 (see FIG. 19), each cutout 550 being sized to receive the lock member 540, and a slot hole 560 opened into the seat mount 220 through which the lock member 540 is movable to shift between a locking state in which the lock member 540 is forced by the spring 530 to move into one the at least one cutout 550 and an unlocking state in which the lock member 540 is forced by a user against the spring 530 to move out of the at least one cutout 550, thereby the backrest 300 is rotatable and fixed relative to the seat assembly 200. In a preferred embodiment of the present invention, the lock mechanism 500 may comprise two cutouts 550 diametrically opposite to each other, see particularly to FIG. 19, such that the backrest 300 is rotatable to either a backward position where the backrest 300 is located behind a person or a forward position where the backrest 300 is located in front of the person.

It should be noted that, although a spring is shown in the Figures, other elastic component that can achieve the object of the present invention is possible without departing from the scope of the present invention.

In an embodiment, the rotating sleeve 410 and the backrest support 310 form a unitary body. In another embodiment, the rotating sleeve 410 is removably connected to the backrest support 310, in this case, the backrest 300 may be removed from the chair.

Figure 20:
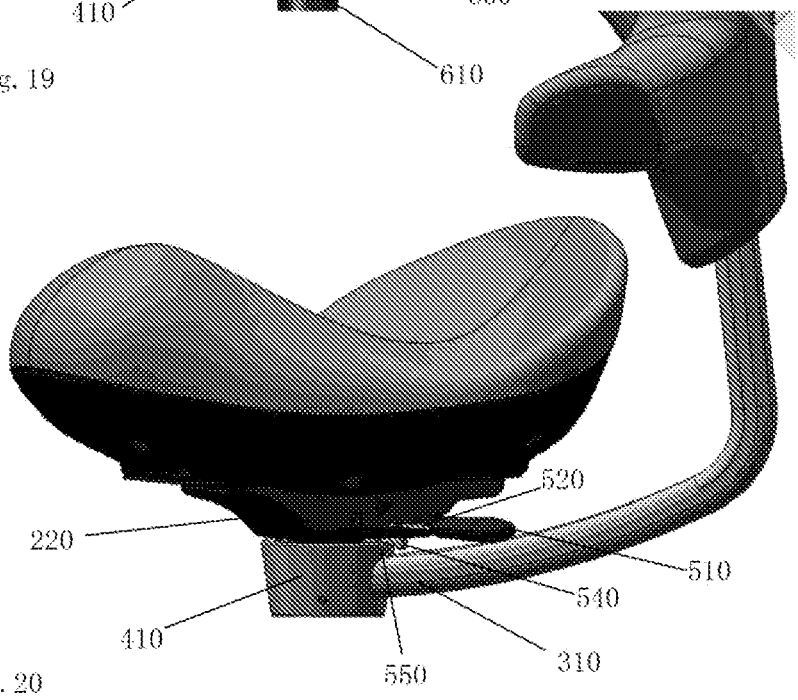
FIG. 20 shows an unlocking state of the lock mechanism in an assembled structure in accordance with an embodiment of the present invention.
Figure 22:
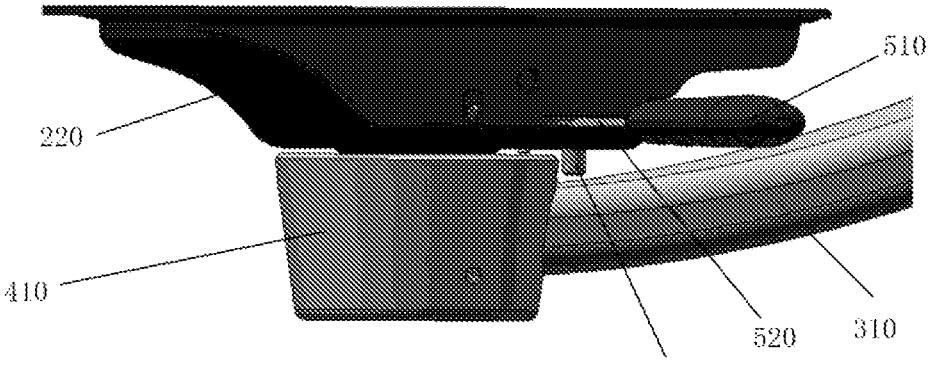
FIG. 22 shows an unlocking state of the lock mechanism in an assembled structure in accordance with an embodiment of the present invention.

In the illustrated form, a person would hold the backrest firmly and pull the lever to the side to unlock and rotate the seat section thereby rotating the backrest in relation to the seat. FIG. 17 shows the top view of the lock mechanism in an unlocking state in which the lever 510 is pulled to one side to unlock the mechanism 500, and FIG. 18 shows the top view of the lock mechanism in a locking state in which no external force is applied to the lever 510 and the lever 520 is forced to the other side under a spring force to bring the lock member 540 into the cutout 550 to lock. FIGS. 20 and 22 shows an unlocking state of the lock mechanism in an assembled structure, in which the lock member 540 is moved out of the cutout 550.

Figure 19:
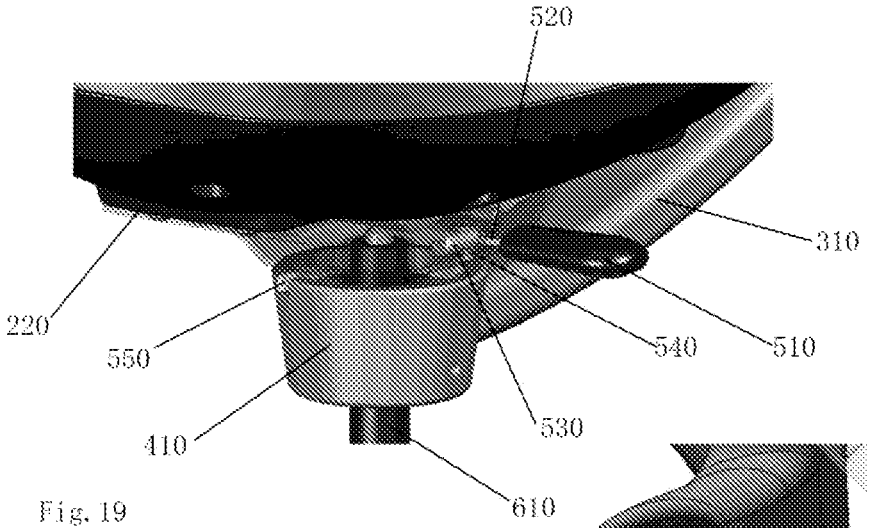
FIG. 19 shows a locking mechanism pre-set for two positions in accordance with an embodiment of the present invention.
Figure 21:
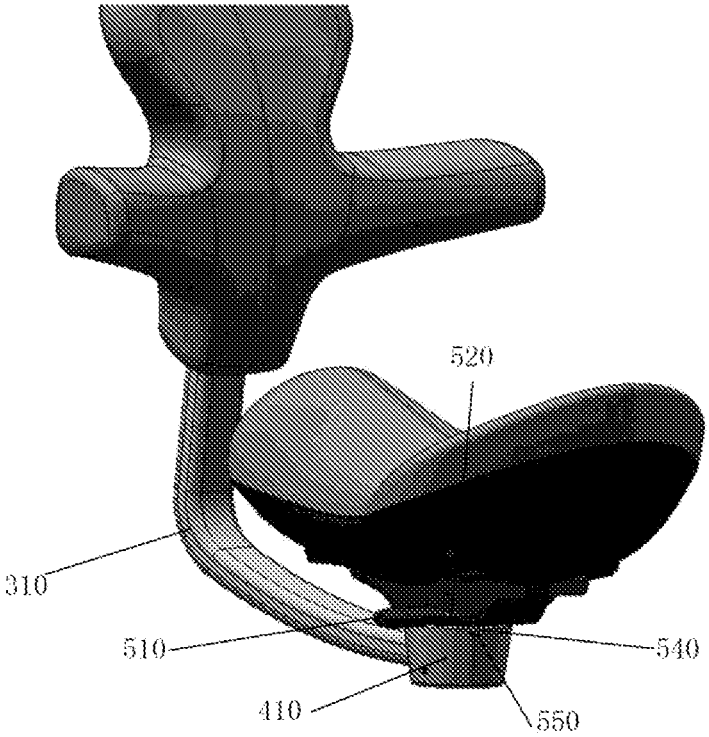
FIG. 21 there is shown in the preferred embodiment a locking mechanism pre-set for two positions in accordance with an embodiment of the present invention.

Turning next to FIG. 21 and FIG. 19, there is shown in the preferred embodiment a lock mechanism pre-set for two positions. The spring component causes the locking mechanism to automatically lock into place employing a cutout at each position. More than two preset positions may be used.

Figure 15:
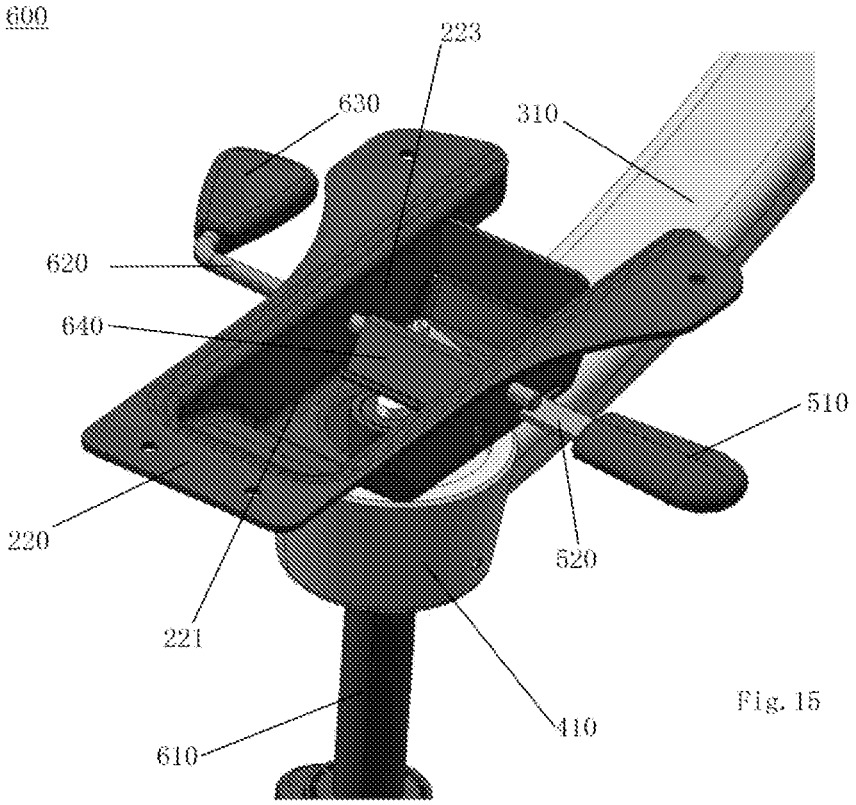
FIG. 15 shows a height adjusting mechanism with use of a lever in accordance with an embodiment of the present invention.
Figure 16:
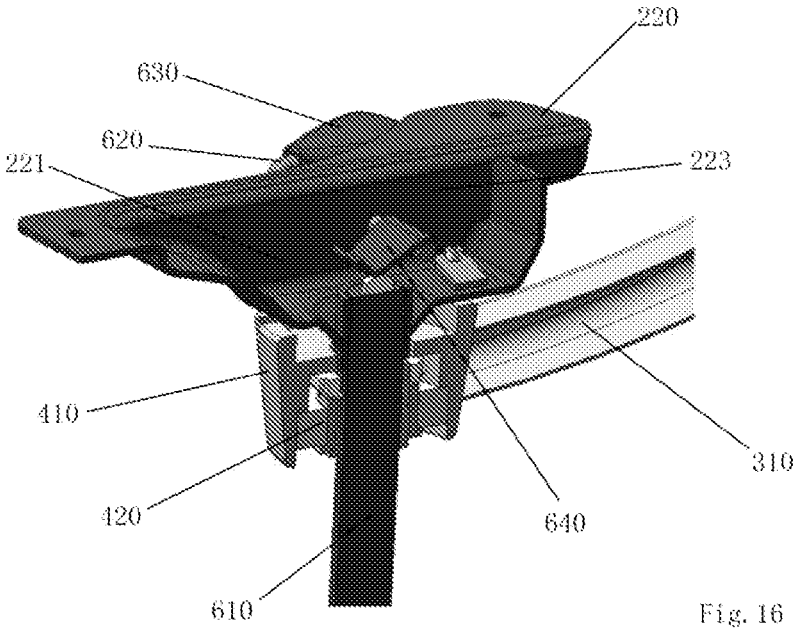
FIG. 16 shows the height adjustment mechanism cut away to show additional detail in accordance with an embodiment of the present invention.

In a preferred embodiment of the present invention, the ergonomic chair may further include a height adjusting mechanism 600 with use of a height adjusting lever 620, as shown in FIG. 15. FIG. 16 shows the height adjusting mechanism 600 cut away to show additional details. In the illustrated embodiment, the height adjusting mechanism 600 may comprise a pneumatic rod 610 passing through a bottom opening 222 opened at a depression 221 formed within the seat mount 220, a height adjusting lever 620 passing through side walls 223 of the depression 221, a height adjusting handle 630 connected to one end of the height adjusting lever 620, and an angle plate 640 fixed onto a section of the height adjusting lever 620 within the depression 221. The angle plate 640 may be configured for pressing down a piston rod of the pneumatic rod 610 when the height adjusting handle 630 is lifted by a person.

In the illustrated embodiment, referring back to FIGS. 4-7, the support structure 100 further comprises a plurality of legs 100, preferably five legs, each being mounted with a swivel caster 120.

According to the present invention, the backrest can be interchanged from the backward and forward positions or removed altogether. With the backrest in the rotated position it is ideal to work off a laptop, tablet or smart phone. With a small amount of weight on the feet the chair is extremely mobile—ideal for the modern workplace. With the rotating backrest it is ideally suited to sitting at the desk in the office or home office.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the currently or later appended claims.

What is claimed is:

1. An ergonomic chair, comprising:

a support structure, a seat assembly comprising a seat, and a seat mount arranged on the support structure, a backrest rotatably connected to the support structure through a backrest support, a rotating mechanism comprising:

a rotating sleeve connected to the backrest support, and a bearing module arranged within the rotating sleeve, and a lock mechanism comprising:

a lock handle, a lock lever with one end pivotally connected to the seat mount and the other end connected to the lock handle, an elastic component connected between the lock lever and the seat mount, a lock member extending towards the rotating sleeve from the lock lever, at least one cutout arranged along the perimeter of the rotating sleeve, each cutout being sized to receive the lock member, and a slot hole opened into the seat mount, wherein the lock member is movable through the slot hole to shift between a locking state in which the lock member is forced by the elastic component to move into the at least one cutout and a unlocking state in which the lock member is forced by a user against the elastic component to move out of the at least one cutout, thereby the backrest is rotatable and fixed relative to the seat assembly.

2. The ergonomic chair of claim 1, wherein the support structure further comprises a height adjusting mechanism comprising:

a pneumatic rod passing through a bottom opening opened at a depression formed within the seat mount, a height adjusting lever passing through side walls of the depression, a height adjusting handle connected to one end of the height adjusting lever, and an angle plate fixed onto a section of the height adjusting lever within the depression, wherein the angle plate is configured for pressing down a piston rod of the pneumatic rod when the height adjusting handle is lifted by a user.

3. The ergonomic chair of claim 2, wherein the support structure further comprises a plurality of legs each being mounted with a swivel caster.

4. The ergonomic chair of claim 1, wherein the seat mount is made of metal.

5. The ergonomic chair of claim 1, wherein the backrest further comprises a main portion, a first armrest portion and a second armrest portion extending from the main portion laterally in opposite directions.

6. The ergonomic chair of claim 5, wherein the main portion further comprises a top section, a middle section and a bottom section, and wherein the backrest further comprises a first arc-shaped section formed between the top section and the first armrest portion, a second arc-shaped section formed between the top section and the second armrest portion, a third arc-shaped section formed between the bottom section and the first armrest portion, and a fourth arc-shaped section formed between the bottom section and the second armrest portion.

7. The ergonomic chair of claim 6, wherein the top section and the bottom section both taper to the middle section by their width.

8. The ergonomic chair of claim 1, wherein the backrest further comprises a backrest frame and a backrest cover attached onto the backrest frame.

9. The ergonomic chair of claim 8, wherein the backrest is made of plastic.

10. The ergonomic chair of claim 8, wherein the backrest cover is made of foam and fabric.

11. The ergonomic chair of claim 8, wherein the backrest frame is hollow with an opening, and the backrest support is inserted into the backrest frame for attachment thereto through the opening.

12. The ergonomic chair of claim 1, wherein the seat further comprises a seat base arranged on the seat mount, a seat frame attached onto the seat base, and a seat cushion attached onto the seat frame.

13. The ergonomic chair of claim 12, wherein the seat base and the seat frame are made of plastic.

14. The ergonomic chair of claim 12, wherein the seat cushion is made of foam and fabric.

15. The ergonomic chair of claim 12, wherein the seat comprises a rear portion and a raised front portion, and the rear portion is shaped to accommodate a user's hip.

* * * * *